US006250974B1

(12) United States Patent
Kerek

(10) Patent No.: US 6,250,974 B1
(45) Date of Patent: Jun. 26, 2001

(54) HOODLESS ELECTRICAL SOCKET CONTACT

(75) Inventor: Leslie Laszlo Kerek, Los Angeles, CA (US)

(73) Assignee: Tri-Star Electronics International, Inc., El Segundo, CA (US)

( * ) Notice: Subject to any disclaimer, the term of this patent is extended or adjusted under 35 U.S.C. 154(b) by 0 days.

(21) Appl. No.: 09/395,515

(22) Filed: Sep. 14, 1999

Related U.S. Application Data

(63) Continuation-in-part of application No. 09/104,733, filed on Jun. 25, 1998, now abandoned.

(51) Int. Cl.[7] ..... H01R 13/187
(52) U.S. Cl. ..... 439/843
(58) Field of Search ..... 439/843, 851, 439/856, 845

(56) References Cited

U.S. PATENT DOCUMENTS

| | | | | |
|---|---|---|---|---|
| 4,720,157 | * | 1/1988 | Nestor et al. | 439/851 |
| 5,108,318 | * | 4/1992 | Sakurai et al. | 439/843 |
| 5,186,663 | * | 2/1993 | Wymelenberg | 439/843 |
| 5,667,413 | * | 9/1997 | Trafton | 439/843 |

* cited by examiner

*Primary Examiner*—Brian Sircus
*Assistant Examiner*—Javaid Nasri
(74) *Attorney, Agent, or Firm*—Harold L. Jackson

(57) ABSTRACT

A connector terminal is disclosed including a cylindrical socket body with a spring contact inserted therein. The spring contact has a distal portion that establishes a press fit with the socket body. The socket body may be crimped over the distal portion to more securely hold the spring contact in the socket body. The spring contact further has a plurality of fingers which taper forwardly and inwardly to resiliently grab a male pin as it enters the socket.

20 Claims, 5 Drawing Sheets

HOODLESS ELECTRICAL SOCKET CONTACT

RELATED APPLICATION

This application is a continuation-in-part of my application Ser. No. 09/104,733 filed Jun. 25, 1998 entitled Hoodless Electrical Socket Connector which was abandoned on Feb. 4, 2000.

FIELD OF THE INVENTION

This invention relates generally to electrical contacts, and more particularly, it is directed to a hoodless socket contact and method for making the same.

BACKGROUND OF THE INVENTION

Electrical contacts are present in all avionics, military and aerospace equipment environment such as in helicopters, missiles and planes. Such equipment may have dozens or even hundreds or even thousands of electrical connections that must be made between electronic power supplies, sensors, activators, circuit boards, bus wiring, wiring harnesses, to provide the electrical pathways or highways needed to transport electricity in the form of control signals and power. The hardware reliability requirements for operating in an avionics environment are stringent as a failure can have catastrophic consequences. As such, the electrical components and circuitry, as well as the connectors and contacts therein employed to electrically connect these items, must work in a wide range and wide variety of environmental conditions such as mechanical, vibration, wide temperature ranges, humidity and corrosive elements, etc. For example, military standards (also known in the industry as mil specs) for aircraft avionics equipment require that contacts be able to mate and unmate a minimum of five hundred times without a failure during all anticipated environmental and mechanical conditions. In addition, the contact assemblies must be protected to withstand repeated handling without significant distortion or damage to the interconnecting parts which could lead to a lack of electrical continuity.

One example of a high-amperage power socket contact or terminal is illustrated in U.S. Pat. No. 5,376,012 "Power Port Terminal" to Clark which includes a contact socket receiving portion and an integral mounting portion. The socket includes a web with a plurality of beams thereon. Each of the beams has a curved surface with a bend, which beams cooperate to form an axially extending tubular socket region which accepts a pin terminal of any desired length. Disadvantageously, the beams are exposed and therefore subject to damage. Additionally, the beams of the socket contact are not protected from entry of an oversize male contact, which may bend the beams beyond their elastic limit thereby damage the connector so that it will not perform electrically.

Another example of a socket contact is illustrated in U.S. Pat. No. 4,906,212 entitled "Electrical Pin and Socket Connector" to Mixon, Jr. which includes a socket have a cylindrical mating portion defined by cantilever beams having one or more blades wherein one or more of the blades include a rearwardly extending free end. The pin includes a mating portion having a bullet nose at one end and a wire barrel at another end. This connector suffers from the same limitations as the Clark connector and therefore is an undesirable alternative in environments where high reliability is critical.

A prior art female contact which is used in non-critical and in non-aerospace applications is shown in FIG. 1 which contact includes a cylindrical member 10 having holes 12 and 14 in the ends thereof. A spring member 16 is inserted in one of the ends, the spring member tapering rearwardly into the hole 12. Accordingly, a male pin contact inserted into the cylindrical member 10 would be grasped by the spring member 16 relatively deeply within the hole 12 which is disadvantageous. The distance from the free end 15 of the socket to the point of engagement 17 with a male contact or pin is designated by the letter "l" in FIG. 1 (and in FIG. 2). The particular connector halves in which the male and female contacts are used (and the positioning of the connector halves on the equipment, e.g., trays and black boxes) may result in a lesser or greater penetration of the male pins into the socket body. Furthermore, there is no mechanical structure to ensure that the spring member 16 will remain in place and as such the spring may "walk out" of the hole during vibration or during mating and unmating cycles. Mil specs require that a spring member which provides the electrical continuity must be able to withstand the separation force during the unmating cycle (i.e., 500) without being dislodged under all anticipated environmental conditions including vibration. The arrangement of the spring 16 socket member 10 could be potentially hazardous if used in avionics environments where high reliability is a must for human safety.

Another example of a socket contact that is successfully manufactured and sold by the assignee of the present invention is shown in FIG. 2. This contact 20, sometimes referred to as a hooded socket contact, includes a tubular socket body 22 having a plurality of tines 24 for receiving a male contact or pin. A hood 26 is inserted over the tines 24 and rear portion of a contact to protect the tines from damage. The hood is generally made of stainless steel with a wall thickness of only 0.004 to 0.010" for economic and reliability reasons. The hood is press fit over the cylindrical shoulder portion 28 at the rear of the contact. This press fit arrangement, due to the hood's wall thickness, requires precision manufacturing. Improper sizing of the socket body shoulder may result in damage to the hood during the press fit operation or the hood may come loose during use. Plating of the contact may exacerbate the press fit step during manufacturing. Furthermore, a stainless steel hood may not be tolerated in certain applications where interference with magnetic fields is a problem. In summary, the manufacturing steps necessary to insure reliable performance of the hooded type contact shown in FIG. 2 may result in a fairly expensive contact when mass produced.

Accordingly, there is a need for an improved socket contact that is simple to manufacture yet reliable in performance and that can be made in mass quantities at relatively low cost.

SUMMARY OF THE INVENTION

The foregoing mentioned disadvantages are avoided by providing a hoodless socket or female contact for engaging a male pin contact. The female contact includes a socket body with two ends, each end having an axially oriented hole or bore. A spring for making an electrical connection with a male contact or pin is located in one of the holes. The spring is arranged for resiliently engaging the male pin contact in close proximity to the hole entry point or free end of the socket body. Means are provided for securely holding the spring in the hole, which may be established by a press fit of the spring within the hole coupled with an extension of the socket body overlaying a portion of the spring thereby preventing the spring from exiting from the socket body.

Alternatively, the spring may be securely coupled in the socket body by crimping the socket body onto the spring. Preferably, this is achieved by crimping a portion of the socket body into a peripheral annular groove in the spring. Barbs on the spring, which engage the inner wall of the hole of the socket body, may also be employed, with or without crimping, to provide additional security.

The hole at the other end of the socket body is sized and shaped to receive a conductor such as a insulated copper wire. The conductor may be electrically and mechanically secured together with the socket body by crimping the socket body onto the conductor.

The construction and operation of preferred embodiments of the contact of the present invention may best be understood by reference to the following description taken in conjunction with the accompanying drawings in which like components or features are designated by the same or primed reference numbers.

DESCRIPTION OF THE PREFERRED EMBODIMENT

Figure 1:
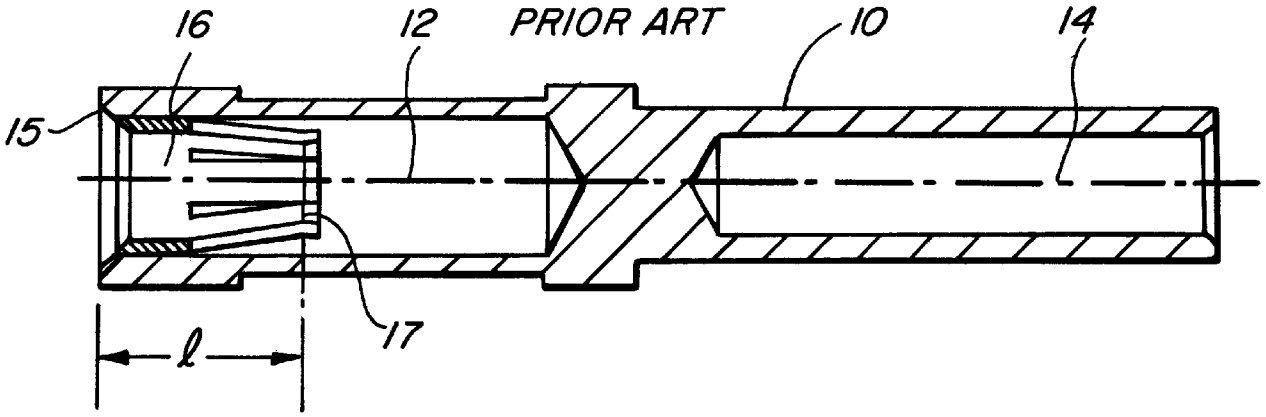
FIG. 1 PRIOR ART
FIG. 1 is a side cross-sectional view of a prior art contact.
Figure 2:
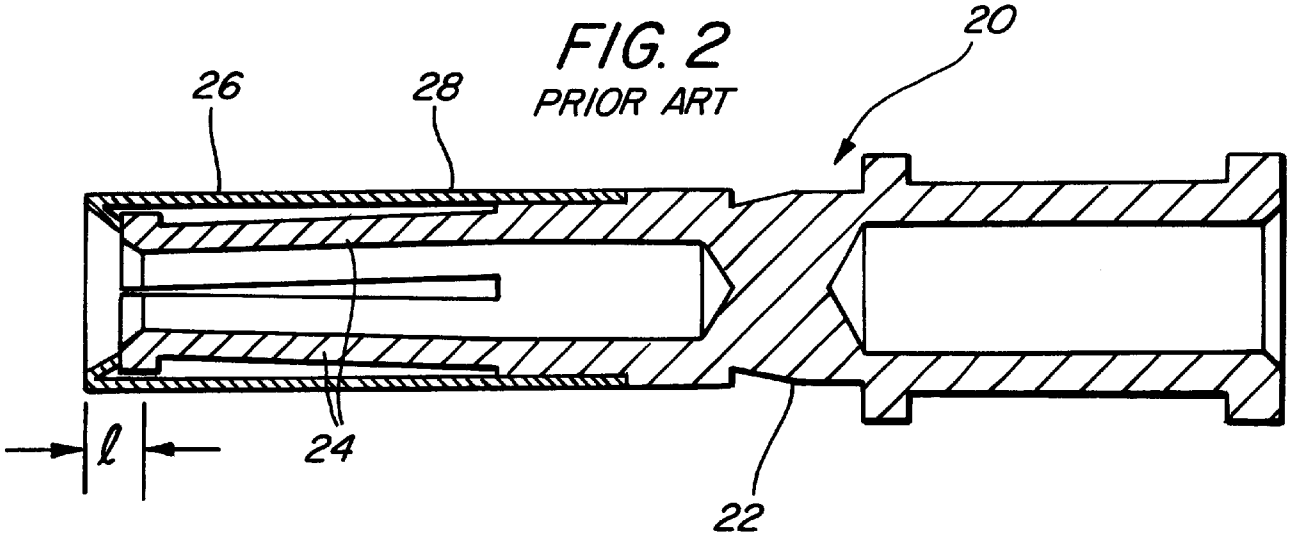
FIG. 2 PRIOR ART
FIG. 2 is a side cross-sectional view of another prior art contact.
Figure 3:
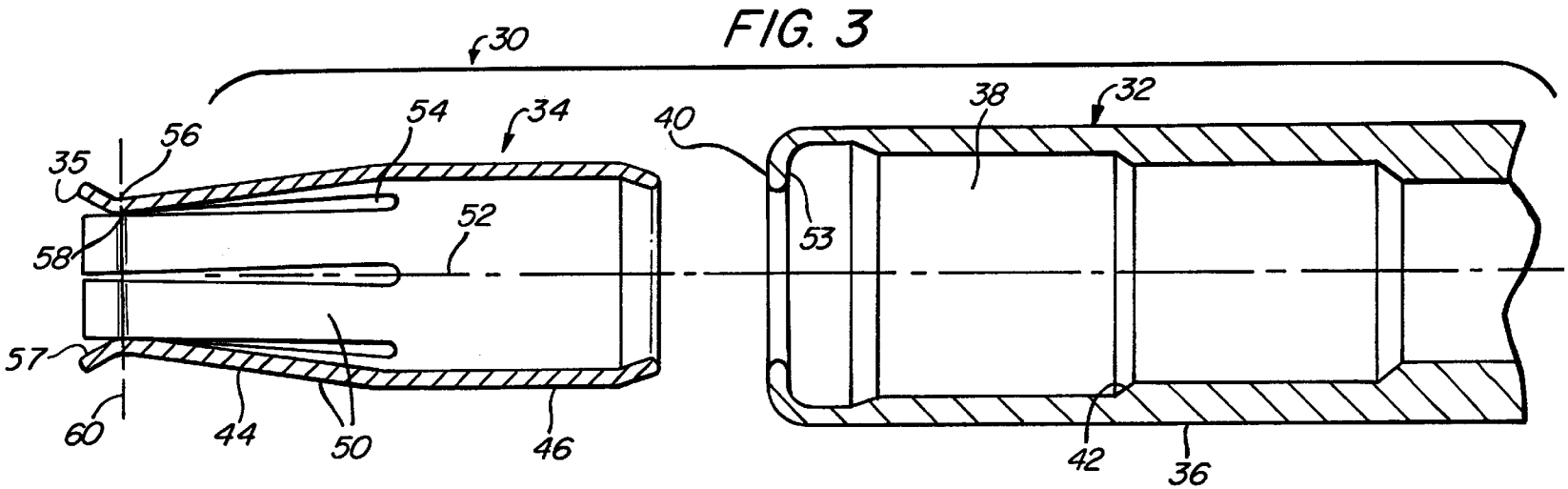
FIG. 3 is a side cross-sectional, partially broken away side view of a socket contact in accordance with the principles of the invention illustrating the two parts of the socket contact prior to assembly.
Figure 4:
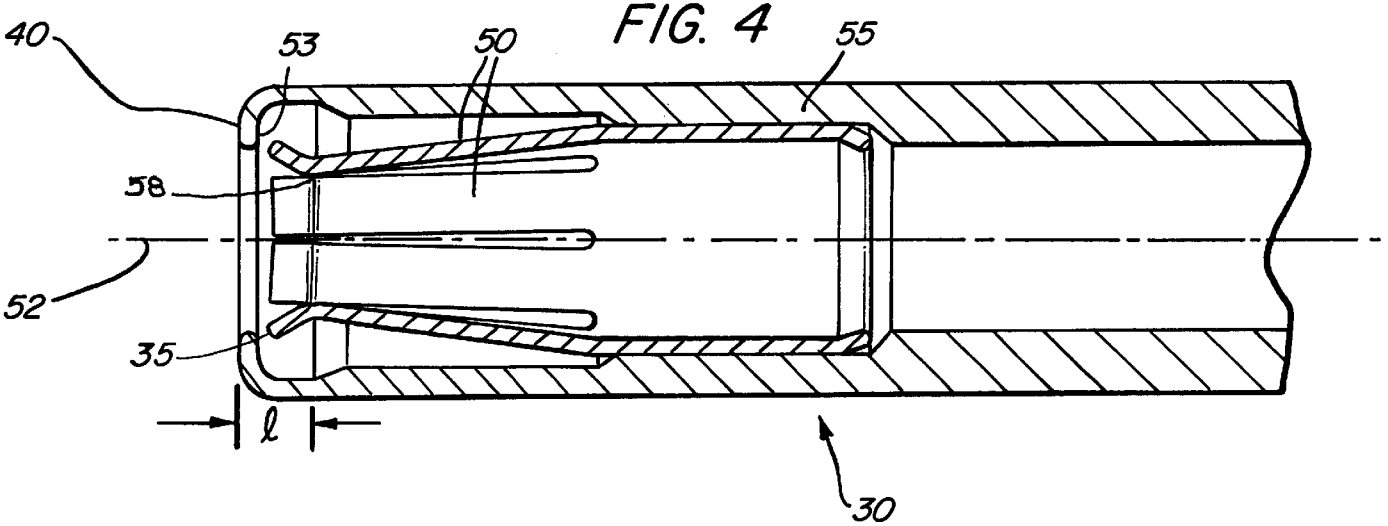
FIG. 4 is a side cross-sectional, partially broken away side view of the contact parts of FIG. 3 assembled together.

Referring now to the drawings and more particularity to FIGS. 3 and 4, there is shown a socket contact generally indicated by reference number 30. The socket contact, sometimes hereinafter referred to as a hoodless socket, is made from two parts including a socket body 32 and a spring 34. The socket body 32 consists of a cylindrically or tubularly shaped member 36 having two ends, with an axially disposed male-contact-receiving hole or bore 38 extending from one of the ends 40 (i.e., free end) into the socket body a preselected distance and a conductor or wire receiving hole of bore 39 at the other end 41 thereof. See FIG. 11. The socket body 32 may be made of an electrically conductive material such as a brass/copper alloy. The male-contact-receiving hole 38 may have an inwardly projecting shoulder 42 that provides a back stop for the seating of the spring 34.

The spring 34 contains a forward male contact receiving portion 44 and a rear mounting portion 46. The contact receiving portion 44 includes a plurality of fingers or tines 50. The fingers are arranged around the longitudinal axis 52 of the spring 34 and are separated by gaps or slots 54 between adjacent fingers. Each of the forwardly extending fingers tapers inwardly to define together a tubularly shaped contact region 56 and 58 which engages a male pin inserted 3 therebetween and to provide a reliable electrical connection therebetween under anticipated adverse conditions. The portion of the fingers forward of the contact region 56 bend outwardly to form a flared region 57 which acts as a centralizer for guiding the insertion of a male pin. The tubularly shaped contact region 56 at the bends define a plane curved contact surface which surface may be in radial plane such as the an annular contact surface 58 at a preselected point 60 along a longitudinal axis 52. The preselected point for annular contact surface 58 of the spring 34 is spaced within about 0.020 to 0.045 inches, and preferably about 0.035 inches maximum, from the free end 40 of the socket body when the spring contact is secured therewith, i.e., equals about 0.020" to 0.045" and preferably about 0.035" maximum. The distance from the free end 40 of the socket body to the annular contact surface 58 is designated by the letter " " in FIG. 4. The aforedescribed arrangement between the socket body and spring thus allows electrical contact to be made with a male contact close to the end 40 of the socket body. This advantageously provides electrical contact to be made immediately essentially upon coupling a male contact (not shown) to the hoodless female contact 30, as required by the applicable mil specs.

Figure 5:
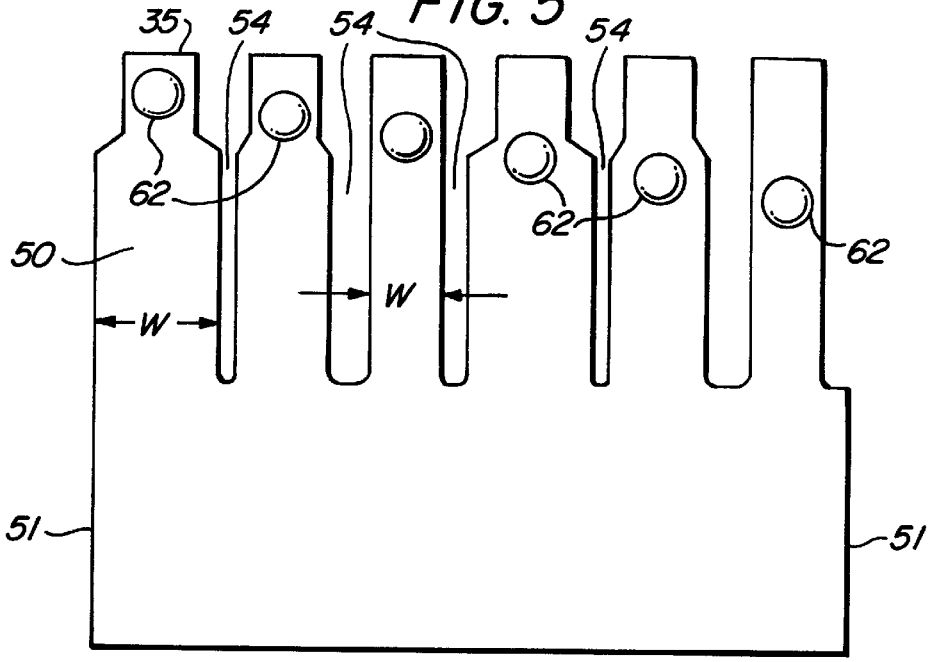
FIG. 5 is a side view of a stamped out spring prior to roll forming.
Figure 6A:
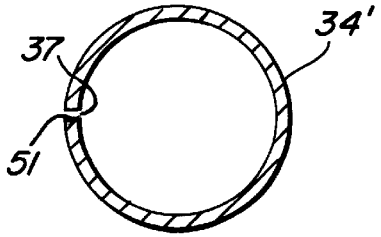
FIGS. 6A and B are cross-sectional views illustrating a spring made from roll forming ("seam type") or deep drawn ("seamless type") processes, respectively.
Figure 6B:
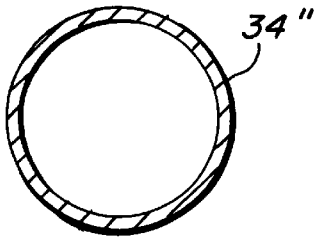

The spring 34' may be of the seam type in which case it is made in a flat configuration, as illustrated in FIG. 5, and then roll formed into the form of a sleeve. A small gap 37 is formed between the edges 51, as shown in FIG. 6A. This gap may visually disappear as a result of the roll formation and press fit steps. Alternatively, the spring 34' may be of the seamless type made, for example, by deep drawing process well known in the art, as shown in FIG. 6B.

Figure 7:
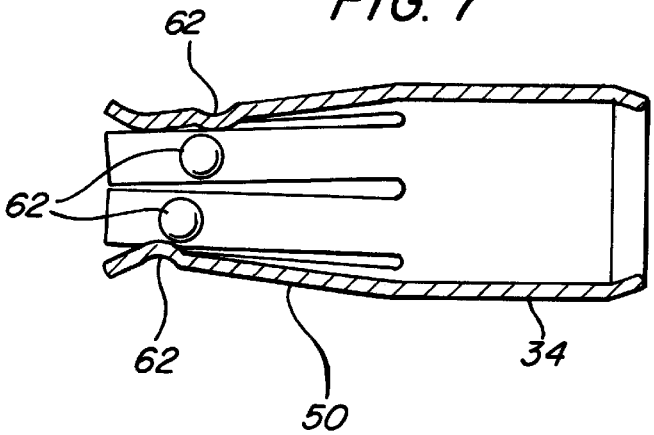
FIG. 7 is a side cross-sectional view of the spring with dimples.

While the fingers 50 described hereinabove provide good electrical continuity to a male terminal, increased electrical contact may be established by providing the contact region 56 with inwardly disposed dimples 62, as shown in FIG. 7. While the dimples could be disposed on the same radial plane, preferably the dimples 62 are staggered on the fingers 50, i.e., disposed at different axial distances from the free end of the socket body as shown more particularity in FIG. 5. This advantageously reduces the insertion force needed to insert a male pin between the fingers 50 than when the dimples 62 are all on the same radial plane, while increasing the retention force provided by the fingers 50. Additionally, by staggering the dimples 62, the resonance point of the individual fingers 50 will vary during vibration, thus mitigating open circuit faults. Fingers having different widths "W", as illustrated in FIG. 5, also aid in overcoming the resonance problem encountered with conventional spring contacts. The dimples 62 further assure that a gas-tight connection is established between the fingers and a male contact. Such a gas-tight connection seals out corrosive gases and thereby prevents formation of films or corrosives on the surfaces interconnecting the mating male/female contacts that could degrade the electrical conductivity therebetween and cause failures in the connection. It should be noted that dimples or fingers having differing widths may not be necessary in many applications.

Figure 8A:
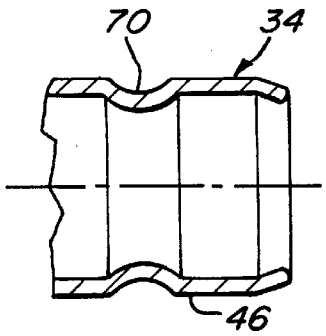
FIGS. 8A–C are partial side cross-sectional views of the back end of the spring with optional groove configurations therein.
Figure 8B:
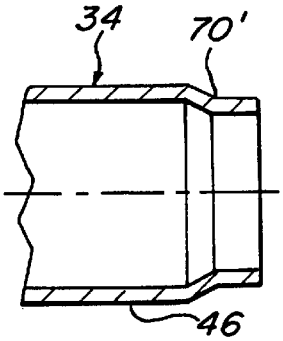
Figure 8C:
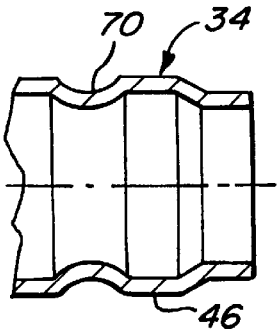
Figure 9:
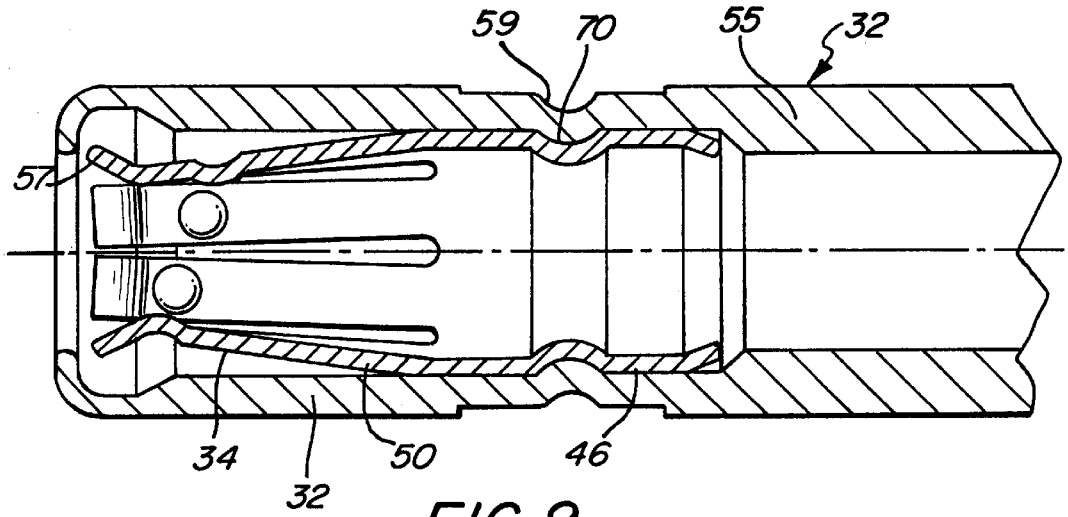
FIG. 9 is a cross-sectional side view of an assembled socket contact that has been crimped.

The spring 34 may be retained within the hole 38 of the socket body 32 by inserting the contact into the socket body with a press fit configuration and thereafter rolling the free end of the socket body radially inwardly to form an annular shoulder 53 which will engage end 35 of the spring in the event that a sufficient force is applied to the spring tending to pull the spring out of the socket body. See FIG. 4. Alternatively, or in addition thereto, the rear mounting portion 46 of the spring contact may have an annular groove 70 therein, shown with more particularity in FIG. 8A. After assembly, the wall of the socket body 32 may be roll crimped such that a portion 59 of the socket body wall is rolled into the groove 70, as shown in FIG. 9. The rear mounting portion 46 of the spring 34 may have a variety of groove configurations, as shown with more particularity in FIGS. 8A–C.

Figure 10:
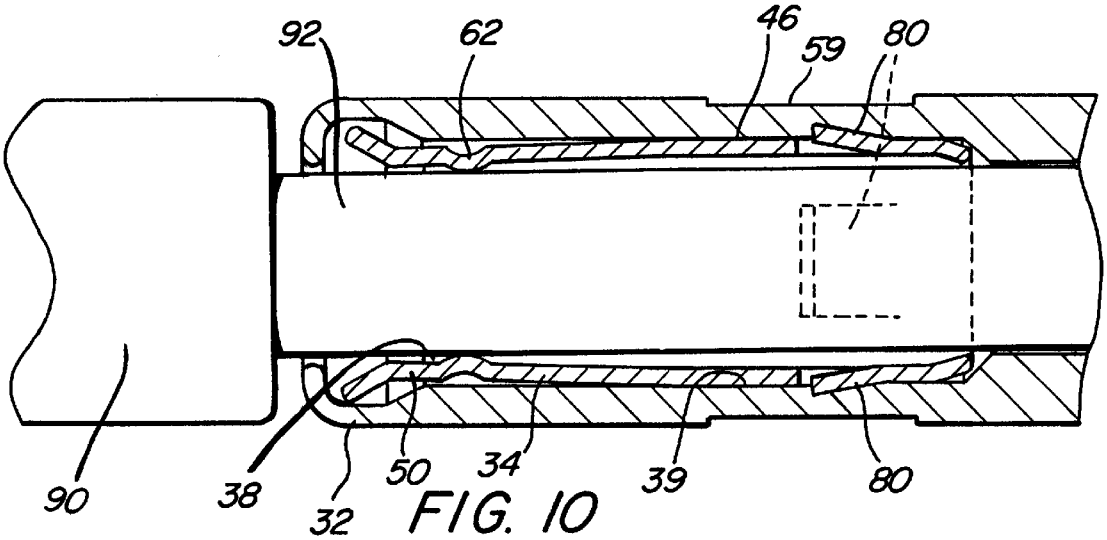
FIG. 10 is a cross-sectional view of another assembled socket contact wherein the two parts are assembled together and in additional are also retained by barbs and a pin terminal is inserted into the socket contact.

Another means for retaining the spring in the socket body is shown in FIG. 10. In this embodiment, the rear mounting portion 46 of the spring has a plurality of outwardly extending spring retention barbs 80. The barbs 80 resiliently compress inward upon insertion of the spring 34 into the hole 38, but dig into the inner wall 38 of the hole to resist removal. As further illustrated in FIG. 10, the pin portion 92 of a male contact 90 is inserted between fingers 50 which spread to resiliently grasp the pin portion 92 via the dimples 62. It should be noted that the dimples 62 are optional.

Figure 11:
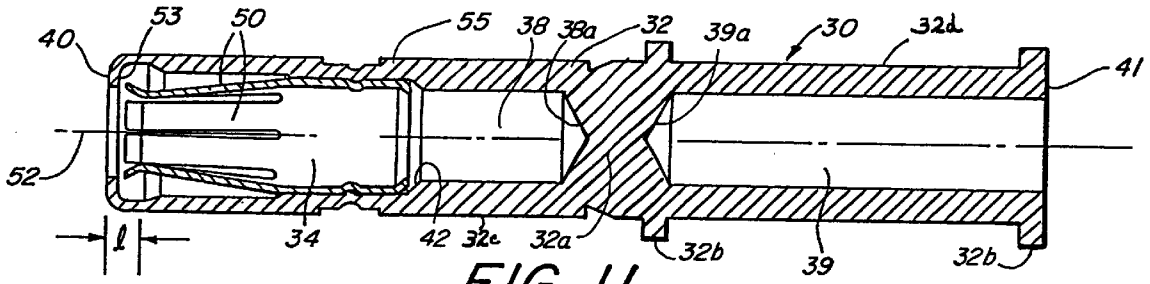
FIG. 11 is a cross-sectional side view illustrating the two parts of the socket contact prior to assembly with an electrical conductor.
Figure 12:
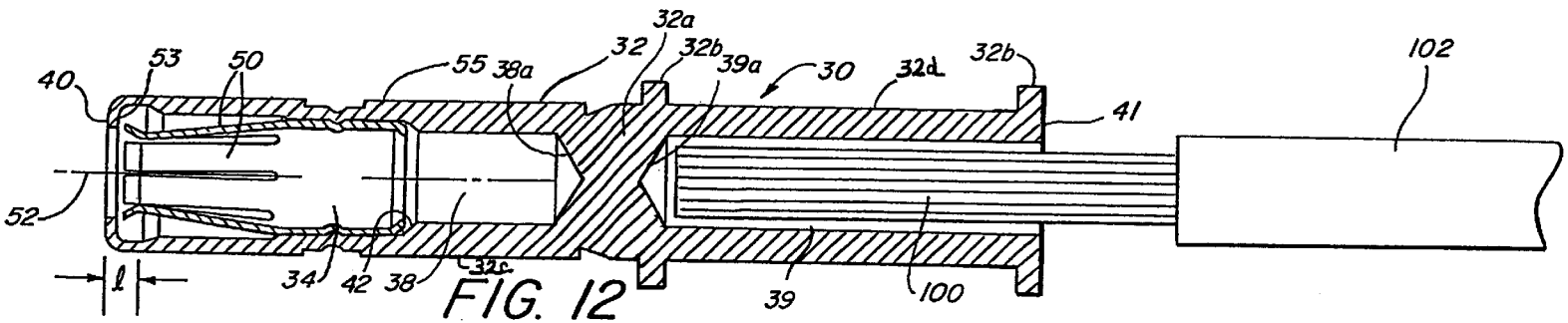
FIG. 12 is a cross-sectional side view of the socket contact with metal stands of an insulated conductor wire inserted into the rear portion of the socket body prior to crimping.
Figure 13:
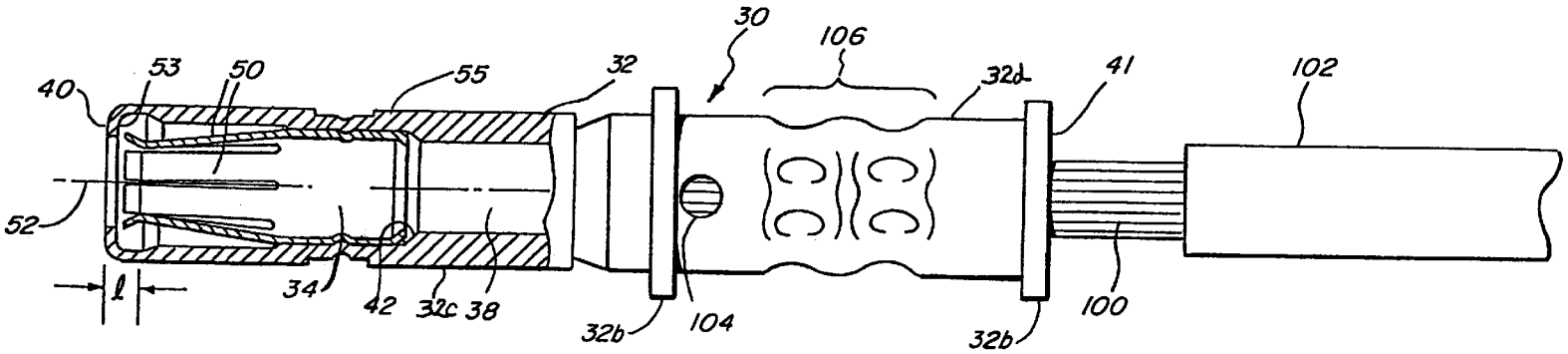
FIG. 13 is a partially broken away side view of the socket contact with the rear portion of the socket body crimped onto the wire strands.

FIGS. 11–13 illustrate an attachment mechanism for electrically connecting the socket body 32 to an electrical conductor 102, such as a conventional insulated copper wire, for example. The socket body 32 includes a forward (first) tubular portion 32*c* and a rearward (second) tubular portion 32*d* separated by a solid center section 32*a*. The second or rearward portion 32*c* forms a wire receiving end 41 which opens to a rear hole or blind bore 39 which receives the copper strands 100 of insulated wire 102. The first or forward tubular portion 32*c* includes the male contact receiving blind bore 38 discussed previously. The front and rear bores 38 and 39 are closed by end walls 38*a* and 39*a*, respectively, formed by center section 32*a* of the socket body. The socket body 32 includes a pair of spaced radially extending shoulders 32*b*.

As is shown in FIG. 12, the wire strands 100 of the conductor 100 are inserted a predetermined distance into hole 39, which insertion may be aided by a small viewing hole 104 (shown in FIG. 13). The distal end wall 39*a* of the hole 39, in any event, limits the insertion distance of the wire. A selected portion 106 of the socket body 32, extending over the wire strands 100, is crimped onto the wire strands to make good electrical contact therewith and mechanically hold the wire strands 100 in the socket body 32, as shown in FIG. 13. Advantageously, the socket body while serving to hold and protect the spring also provides for direct attachment to conductor wires and the like without the need for additional parts. It should be noted that while it is preferable to provide separate front (first) and rear (second) holes, 38 and 39, respectively, separated by a center section 32*a* of the socket body, the hole or bore could be continuous, i.e., one long bore.

There has thus been described an improved contact arrangement which can be cost effective manufactured on a repetitive basis. This spring is protected from damage by the socket body. The dimples, when utilized, provide an increased gas tight point(s) of contact, allowing thinner or less noble electrical conductive plating to used on the fingers. Optionally, staggering the dimples reduces the overall mating and unmating force while maintaining a desired gas tight seal between the fingers and the male contact. Accordingly, various modifications of the hoodless socket, and processes involved in manufacturing the contact terminal, will occur to persons skilled in the art without involving any departure from the spirit and scope of the invention as set forth in the appended claims.

What is claimed is:

1. A two piece hoodless female contact for engaging a male pin comprising:

a socket body forming one piece of the contact, the socket body having a first tubular portion and a second portion extending alone a longitudinal axis, the first portion having an axial hole therein defining an open free male contact receiving end, the second portion having an open wire-receiving end for connection with an electrical conductor; and a separate spring forming another piece of the contact, the spring being located in the axial hole defining the male contact receiving end of the first tubular portion, the spring including a forward portion and rear portion, the forward portion having a plurality of forwardly and inwardly extending fingers which terminate near the free male contact receiving end of the first tubular portion for resiliently grasping a male pin in close proximity to the free male contact receiving end.

2. The contact defined in claim 1 wherein the socket body further includes a third portion in the form of a solid generally cylindrical section disposed between the first and second portions and wherein each of the fingers includes a male pin engaging surface and wherein the male pin engaging surfaces of the fingers are arranged to grasp the male pin at a distance along the longitudinal axis within a range of about 0.025 to 0.045 inches from the free male contact receiving end of the socket body.

3. The contact defined in claim 2 wherein each of the fingers flare outwardly and forwardly of the respective pin engaging surface thereof for facilitating insertion of the male pin in between the fingers.

4. The contact defined in claim 1 wherein each of the fingers has an inwardly disposed dimple which forms the pin engaging surface for engaging the male pin.

5. The contact defined in claim 4 wherein the dimples are staggered along the lengths of the individual fingers with the dimples being positioned at different axial distances from the free male contact receiving end of the first tubular portion of the socket body.

6. The contact defined in claim 1 wherein the first tubular portion of the socket body is crimped onto the rear portion of the spring.

7. The contact defined in claim 1 wherein the forward portion of the spring terminates axially inwardly of the free male contact receiving end of the first tubular portion of the socket body and wherein the free end of the first tubular portion of the socket body is rolled over to extend radially inwardly beyond the forward portion of the spring to prevent removal of the spring from the hole and to center a mating pin contact.

8. A two piece female contact comprising:

a cylindrically shaped socket body member formed as a single part comprising one piece of the contact, the socket body member having first and second tubular portions separated by a solid center portion extending along a longitudinal axis, the first tubular portion defining a first axially disposed blind bore with a free end for receiving a male contact, the second tubular portion defining a second axially disposed blind bore sized and shaped to receive an electrical conductor; and a separate male contact engaging spring forming another piece of the female contact, the spring being seated entirely in the first bore, the spring having front and rear portions, the front portion of the spring having a female coupling portion adjacent to the free end of the first tubular portion of the socket body member and the rear portion of the spring and the first tubular portion of the body member having cooperative securing means for securely holding the spring in fixed position within the body member.

9. The contact defined in claim 8 wherein the first tubular portion of the socket body member defines a tubular wall and wherein the cooperative securing means comprises a selected portion of the tubular wall being roll formed into the rear portion of the spring.

10. The contact defined in claim 8 wherein the first blind bore has an inwardly projecting shoulder, the rear portion of the spring seating against the shoulder to inhibit rearward movement of the spring within the first blind bore of the body.

11. The contact defined in claim 8 further comprising a male pin adapted to be inserted into the front female coupling portion of the spring, the female coupling portion having a plurality of forwardly projecting fingers which are arranged to engage the male pin inserted therebetween in close proximity to the free end of the first blind bore.

12. The contact defined in claim 11 wherein the fingers have male pin engaging surfaces which are arranged to engage the male pin at a distance of within the range of about 0.025 to 0.45 inches from the free end of the first blind bore.

13. A male/female contact system for coupling a male pin contact to a female socket contact, comprising:

a male pin contact;

a female socket contact formed in two separate pieces, the first piece being in the form of a tubular socket member having a first blind bore therein with an open free end and having a second blind bore therein sized and shaped for receiving an electrical conductor, the tubular socket member consisting of a single part; and the second piece of the female socket contact being a spring member in the form of a sleeve seated in the first blind bore of the tubular socket member and establishing a press fit therein to prevent movement of the spring member relative to the tubular socket member, the spring member having a forwardly extending female coupling portion terminating adjacent the open free end of the first blind bore, said male pin contact being inserted into the open free end and grasped by the female coupling portion.

14. The male/female contact system defined in claim 13 wherein the tight fit between the socket and spring member is established by burrs on one of the members which dig into the other member.

15. The contact defined in claim 13 wherein the spring member has an indentation and the tubular socket member has a cooperative indentation seated therewith for securely holding the two members together.

16. The contact defined in claim 13 wherein the female coupling portion grasps the male contact at a distance within the range of about 0.025 to 0.045 inches of the open free end of the first blind bore.

17. A method for making a two piece female socket contact comprising the steps of:

forming a sleeve spring member having a rear end and a female coupling portion at a forward end;

forming a separate one piece socket body having first and second tubular portions separated by a solid center section, each of the first and second portions having a wall surrounding a blind bore therein, the blind bore in the first tubular portion having a free open end for receiving the spring member and the blind bore in the second tubular portion adapted to receive a conductor;

inserting the spring member entirely within the blind bore in the first tubular portion of the socket body to form a press fit with the female coupling portion being positioned adjacent to the free open end of the blind bore in the first tubular portion;

providing an electrical conductor; and inserting the electrical conductor into the blind bore in the second tubular portion and crimping the wall of the second tubular portion onto the electrical conductor.

18. The method of claim 17 further comprising the step of:

providing a male contact; and inserting the male contact into the spring contact female coupling portion establishing an electrical coupling therebetween.

19. The method of claim 17 wherein the female coupling portion of the spring member is formed with a plurality of resilient fingers which are spread apart upon the insertion of a male contact.

20. The method of claim 19 wherein the plurality of resilient fingers of the spring member have a proximal end positioned adjacent the free open end of the blind bore in the first tubular portion of the socket body and further including the step of rolling the wall of the first tubular portion of the socket body adjacent the free open end of the blind bore in the first tubular portion to form an inwardly projecting shoulder which limits the outward movement of the spring member and and inhibits damage to the spring member by an oversize mating male pin.

* * * * *

UNITED STATES PATENT AND TRADEMARK OFFICE

CERTIFICATE OF CORRECTION

PATENT NO. : 6,250,974 B1
DATED : June 26, 2001
INVENTOR(S) : Kerek

It is certified that error appears in the above-identified patent and that said Letters Patent is hereby corrected as shown below:

Column 2,
Line 11, "1" should read -- "ℓ" --.

Column 4,
Line 19, delete "3".
Line 26, delete "an".
Line 35, " ", should read -- "ℓ" --.

Column 6,
Line 18, "alone" should read -- along --.
Line 29, delete "free".
Line 31, delete "free".

Signed and Sealed this

Twenty-sixth Day of March, 2002

*Attest:*

*Attesting Officer*

JAMES E. ROGAN
*Director of the United States Patent and Trademark Office*

US006250974C1

(12) EX PARTE REEXAMINATION CERTIFICATE (8068th)

United States Patent
Kerek

(10) Number: US 6,250,974 C1
(45) Certificate Issued: Mar. 8, 2011

(54) HOODLESS ELECTRICAL SOCKET CONTACT

(75) Inventor: Leslie Laszlo Kerek, Los Angeles, CA (US)

(73) Assignee: Canadian Imperial Bank of Commerce, New York, NY (US)

Reexamination Request:
No. 90/010,729, Dec. 17, 2009

Reexamination Certificate for:

| | |
|---|---|
| Patent No.: | **6,250,974** |
| Issued: | **Jun. 26, 2001** |
| Appl. No.: | **09/395,515** |
| Filed: | **Sep. 14, 1999** |

Certificate of Correction issued Mar. 26, 2002.

Related U.S. Application Data

(63) Continuation-in-part of application No. 09/104,733, filed on Jun. 25, 1998, now abandoned.

(51) Int. Cl.
*H01R 13/15* (2006.01)
*H01R 13/187* (2006.01)

(52) U.S. Cl. ..... 439/843
(58) Field of Classification Search ..... 439/843
See application file for complete search history.

(56) References Cited

U.S. PATENT DOCUMENTS

| | | | |
|---|---|---|---|
| 4,826,452 | A | 5/1989 | Sian |
| 5,088,942 | A | 2/1992 | Welsh |
| 5,634,825 | A | 6/1997 | Maki |
| 5,667,413 | A | 9/1997 | Trafton |

FOREIGN PATENT DOCUMENTS

| | | |
|---|---|---|
| CH | 353 425 | 4/1961 |
| DE | 27 51 962 | 5/1979 |
| EP | 0 967 684 | 11/1999 |

*Primary Examiner*—James Menefee

(57) ABSTRACT

A connector terminal is disclosed including a cylindrical socket body with a spring contact inserted therein. The spring contact has a distal portion that establishes a press fit with the socket body. The socket body may be crimped over the distal portion to more securely hold the spring contact in the socket body. The spring contact further has a plurality of fingers which taper forwardly and inwardly to resiliently grab a male pin as it enters the socket.

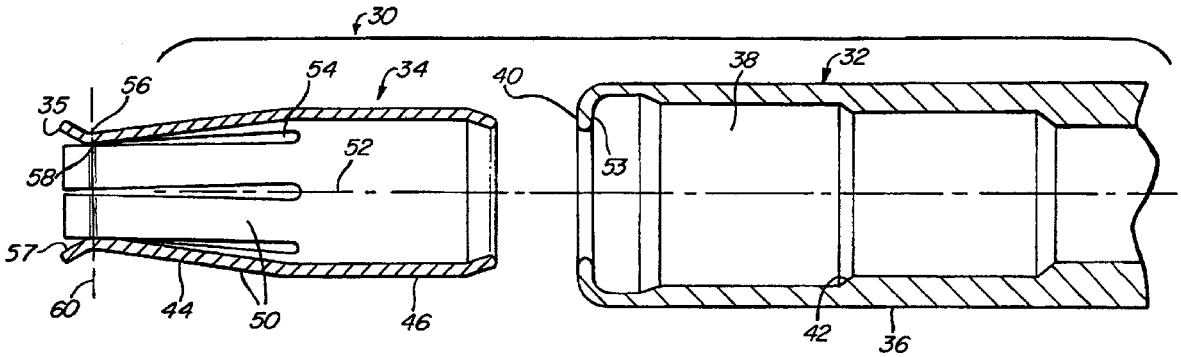

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-20 is confirmed.

* * * * *